United States Patent [19]

Goto

[11] Patent Number: 4,760,676

[45] Date of Patent: Aug. 2, 1988

[54] SYSTEM OF PREFABRICATED COMPONENTS FOR CONSTRUCTING MODULAR HOUSES

[75] Inventor: Mieko Goto, Shizuoka, Japan

[73] Assignee: Minamifuji Sangyo Kabushiki Kaisha, Japan

[21] Appl. No.: 880,943

[22] Filed: Jun. 25, 1986

Related U.S. Application Data

[63] Continuation of Ser. No. 740,750, Jun. 3, 1985, abandoned.

[30] Foreign Application Priority Data

Jun. 6, 1984 [JP] Japan ..... 59-114498

[51] Int. Cl.[4] ..... E04H 1/00

[52] U.S. Cl. ..... 52/236.1; 52/236.3

[58] Field of Search ..... 52/236.1, 79.4, 79.1, 52/234, 236.3

[56] References Cited

U.S. PATENT DOCUMENTS

| | | | |
|---|---|---|---|
| 3,068,534 | 12/1962 | Hu | 52/236.1 |
| 3,302,547 | 2/1967 | Wasserman | 52/236.1 |
| 3,452,493 | 7/1969 | Mims | 52/236.1 |
| 3,543,461 | 12/1970 | Davidson | 52/236.1 |
| 3,789,560 | 2/1974 | Wood | 52/236.1 |
| 4,173,855 | 11/1979 | Raptoplous | 52/236.1 |

FOREIGN PATENT DOCUMENTS

| | | | |
|---|---|---|---|
| 69416 | 1/1952 | Netherlands | 52/236.1 |

*Primary Examiner*—Carl D. Friedman
*Assistant Examiner*—Caroline D. Dennison
*Attorney, Agent, or Firm*—Robert F. Ziems

[57] ABSTRACT

A modular house is composed of eight columns to be provided upright respectively at eight points, each two of which divide each side of an imaginary square on a piece of land into three equal parts, and panels to be attached to the columns. The modular house is of an extremely simple structure, requires a low cost for its manufacture, permits effective utilization of land and easy enlargement and/or remodeling, and provides a wide interior floor area.

7 Claims, 4 Drawing Sheets

SYSTEM OF PREFABRICATED COMPONENTS FOR CONSTRUCTING MODULAR HOUSES

This application is a continuation, of application Ser. No. 740,750, filed 6-3-85, abandoned.

BACKGROUND OF THE INVENTION (1) Field of the Invention

This invention relates to a modular house, more specifically to a low-cost modular house permitting effective utilization of land and easy enlargement or remodeling and having a wide interior floor area.

(2) Description of the Prior Art

In recent years, a variety of modular or prefabricated houses have been developed and proposed with a view toward cutting construction costs. Modular houses permitting effective utilization of land are particularly desirable.

SUMMARY OF THE INVENTION

The present invention has been brought to completion as a result of an extensive research which was conducted with a view toward satisfying various requirements and/or desires on houses.

An object of this invention is to provide a modular house permitting effective utilization of land, having a wide interior floor area and allowing easy enlargement and/or remodeling and moreover, requiring a low cost.

In one aspect of this invention, there is accordingly provided a modular house which comprises eight columns to be provided upright respectively at eight points, each two of which divide each side of an imaginary square on a piece of land into three equal parts, and panels to be attached to the columns.

The modular house of this invention is of an extremely simple structure, requires a low cost for its manufacture, permits effective utilization of land and easy enlargement and/or remodeling, and provides a wide interior floor area.

The above and other objects, features and advantages of the present invention will become apparent from the following description and appended claims, taken in conjunction with the accompanying drawings.

BRIEF DESCRIPTION OF THE DRAWINGS

FIG. 4 is a front elevation of the specific example;

FIG. 5 is a rear elevation of the specific example;

FIG. 6 is a right-hand side elevation of the specific example;

FIG. 7 is a left-hand side elevation of the specific example; and

FIG. 8 is a plan view of the specific example.

DETAILED DESCRIPTION OF THE INVENTION AND PREFERRED EMBODIMENT

Figure 1:
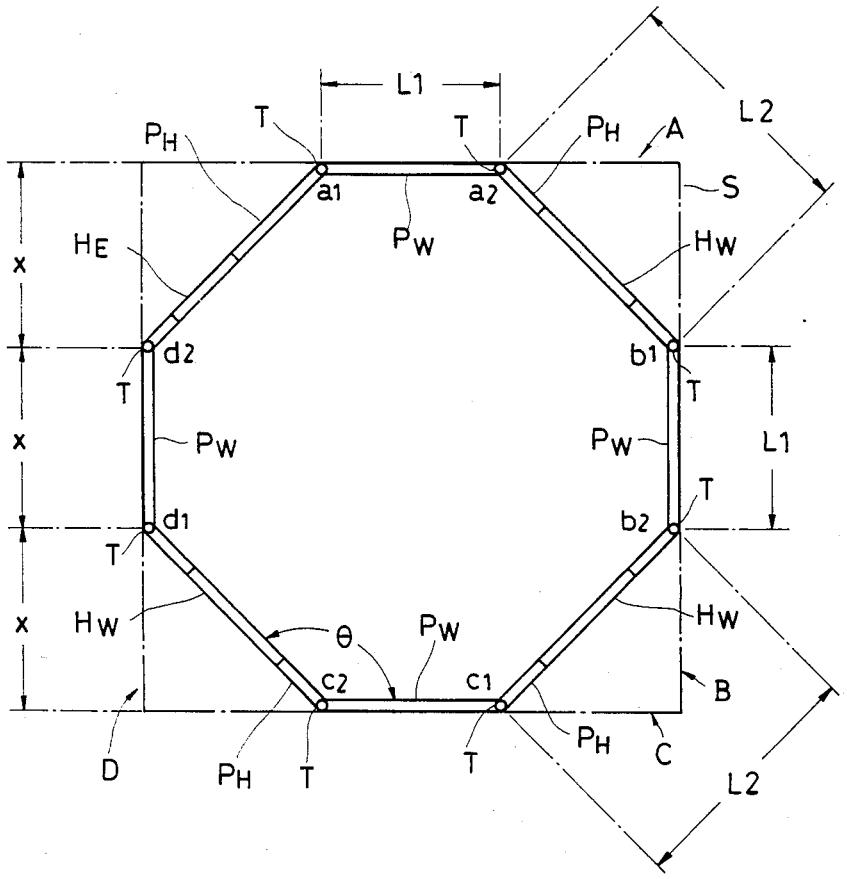
FIG. 1 is a schematic plan view showing the basic structure of a modular house according to one embodiment of this invention.

In the present invention, columns T are provided, as shown in FIG. 1, upright respectively at the trisecting points on the four sides A,B,C,D of an imaginary square S on a piece of land on which a house is to be built, namely, at eight points in total, including two trisecting points a1,a2 on the side A, two trisecting points b1,b2 on the side B, two trisecting points c1,c2 on the side C and two trisecting points d1,d2 on the side D. Beams are then provided between upper parts of mutually-adjacent paired columns T or suitably-selected paired columns T, and panels are provided so as to close up the openings formed between the mutually-adjacent paired columns T. Panels which serve to form opening-free walls, for example, structural wall panels $P_W$ are attached between the two columns on the same sides of the square S, namely, the columns T(a1) and T(a2), the columns T(b1) and T(b2), the columns T(c1) and T(c2), and the columns T(d1) and T(d2), and opening-defining panels $P_H$ including openings such as exit/entrance openings $H_E$, window openings $H_W$ or the like are provided between the mutually-adjacent two columns on the mutually-adjacent two sides of the square S, namely, between the columns T(a2) and T(b1), the columns T(b2) and T(c1), T(c2) and T(d1) and T(d2) and T(a1). Thus, as depicted in FIG. 1, a modular house having an octagonal shape as a whole in plan is set up.

It is possible to add various changes to the above embodiment, including for example use of opening-defining panels instead of some of the structural wall panels $P_W$, use of structural wall panels in place of some of the opening-defining panels $P_H$, and use of a plurality of opening-defining panels $P_H$ including exit/entrance openings $H_E$.

Needless to say, the columns T are provided upright on suitable foundations. By making the heights of the columns T longer, it is feasible to set up a house of the two-story structure.

Owing to the above-described structure, the modular house of this invention can bring about the following various advantageous effects. Since the columns T are provided upright at the trisecting points a1,a2,b1,b2,c1,c2,d1,d2 of the respective sides of the square S, the distance L1 between the columns in each of the four pairs of columns T, each pair of columns being adjacent to each other on their corresponding common side of the square S, is the same as the distance between another pair of columns. On the other hand, the distance L2 between the columns in each of the four pairs of columns T, each pair of columns being respectively on their corresponding mutually-adjacent sides of the square S and being adjacent to each other, is the same as the distance between another paired columns. Supposing that the length of each side of the imaginary square S be 3x, L1 and L2 are x and $\sqrt{2}$ x correspondingly (L1=x and L2=$\sqrt{2}$ x). Accordingly, it is basically sufficient to provide only two types of standardized panels, one having a width of x and the other one a width of $\sqrt{2}$ x, as panels which will serve as wall members in modular houses according to this invention. Industrial mass production of panels can thus be facilitated by adopting such standardization, resulting in modular houses which are low in production cost, and easy in setting-up and hence low in setting-up cost.

In addition, the angle $\theta$ at which two panels extend in two directions with one of the columns T interposed therebetween is basically 3/2 times the right angle (135 degrees) with respect to each of the columns T. Since the modular house of this invention basically requires only two types of panels as mentioned above and this angle $\theta$ is also standardized, especially, to the angle of the specific degree, i.e., 3/2 times the right angle, the modular house of this invention can minimize the wasting of materials, is of a simple structure and requires a short setting-up term only.

Since the columns are arranged in the above-mentioned manner in this invention, it is usually unnecessary to provide any additional upright columns in the space surrounded by a group of panels attached to the columns T although structural wall panels $P_W$ may be provided in some instances. Even when constructing two-story houses, such additional columns are not required in most cases. Moreover, it is octagonal as viewed in plan. Its overall skin area is smaller relative to a unit floor area, compared with a conventional modular house having a square or rectangular shape in plan. Reflecting this feature, the modular house of this invention has materialized reduction to both costs and working term.

The modular house of this invention has a symmetrical octagonal shape as viewed in plan. By installing the opening-bearing panels $P_H$ on the longer sides of the octagon, it is possible to fulfill with ease and perfection various requirements or desires on houses, such as the need for entrance and exit for users, lighting and so on.

Figure 2:
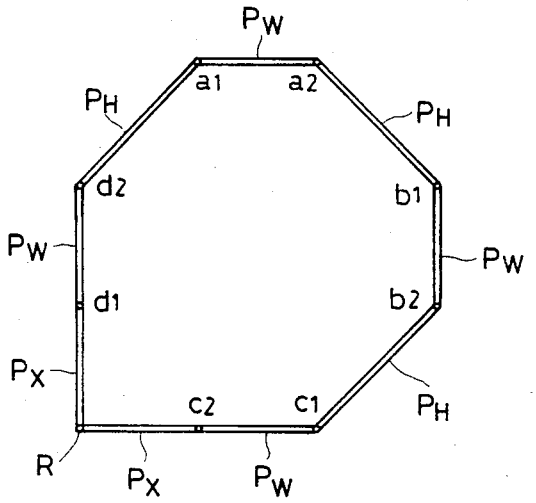
FIG. 2 is a schematic plan view showing one modification of the modular house.

Furthermore, the modular house of this invention has another merit that it permits its modification, remodeling or enlargement with extreme ease. As illustrated by way of example in FIG. 2, its shape as viewed in plan can be easily changed by removing one of the opening-defining panels $P_H$ (the one provided between the column T(c2) and the column T(d1) in the illustrated embodiment) from the structure shown in FIG. 1 and instead, providing an assembled panel unit, which has been formed by connecting at a right angle two panels $P_X$,$P_X$ having the same width as the width L1 of the structural wall panel $P_W$, along the imaginary square S. Here, it is noteworthy that the above modification does not require any other type or types of panels therefor. Designated at letter R is a connector member connecting the panels $P_X$,$P_X$ at a right angle at their respective proximal side edges. It is not absolutely necessary to provide the connector member R upright on a foundation in the same manner as the columns T. Alternatively, the panels $P_X$,$P_X$ may be connected directly to each other.

Since the modular house of this invention permits easy changes or modification to its basic octagonal shape, it may be formed, as viewed in plan, into shapes conforming with the shapes, directions, etc. of individual construction lots, and extremely-effective utilization of the construction lots can hence be achieved. In the present invention, the modular house is not constructed in accordance with the panel method in which the weight of the resulting structure is supported by panels, but is of a structure making use of the framing method in which the weight of the resulting structure is supported by the columns T. It is thus possible to effect the panel installation and removal work with extreme ease, namely, as small work, thereby facilitating its enlargement and remodeling.

Figure 3:
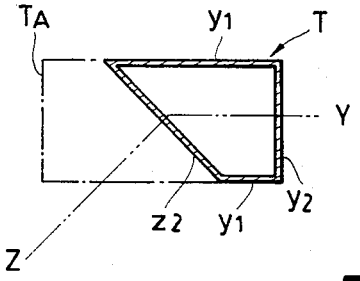
FIG. 3(*a*) through FIG. 3(*c*) are schematic cross-sectional views illustrating examples of columns useful in the modular house.
Figure 3:
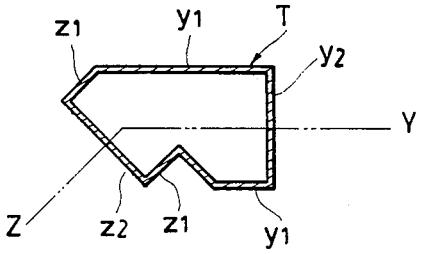
Figure 3:
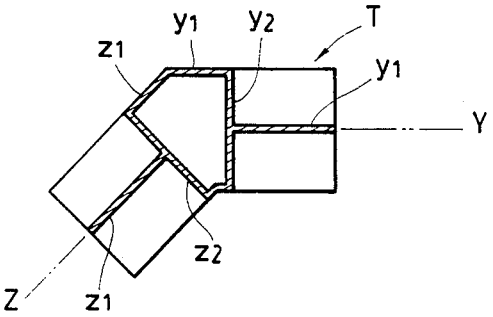
Figure 4:
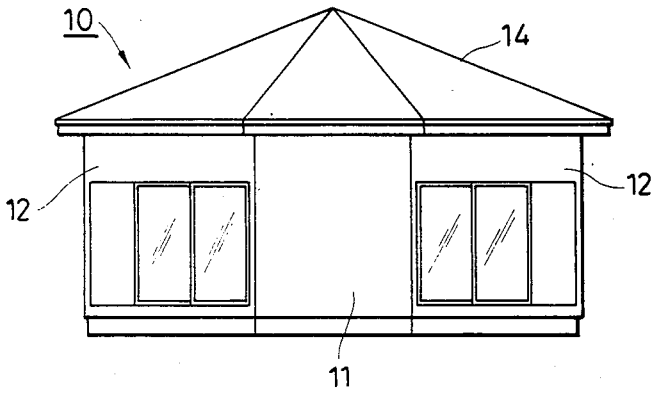
FIG. 4 through FIG. 8 depict one specific example of the modular house of this invention, namely.
Figure 5:
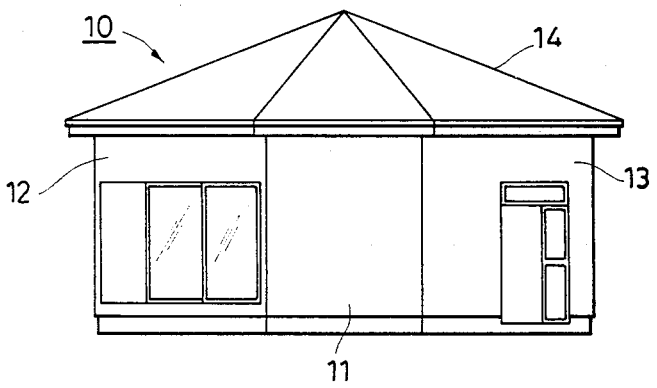
Figure 6:
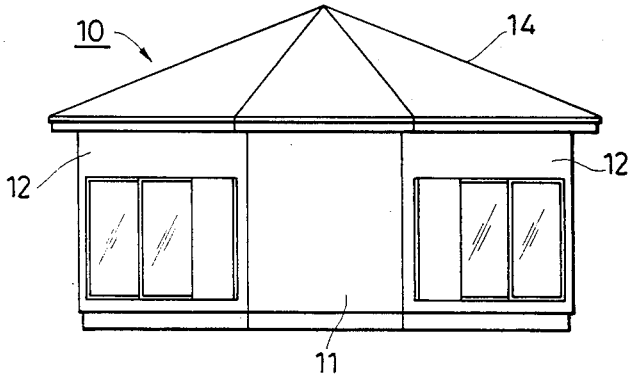
Figure 7:
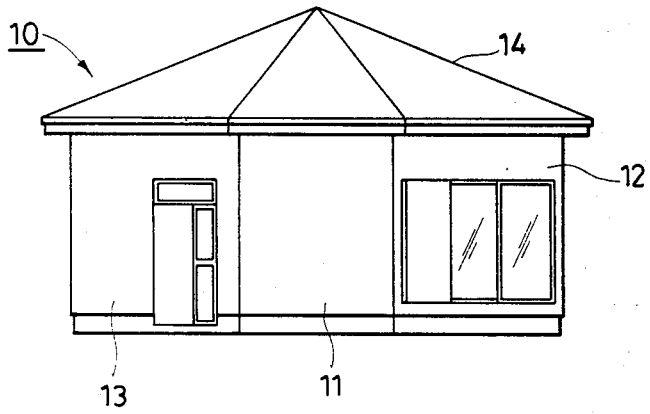
Figure 8:
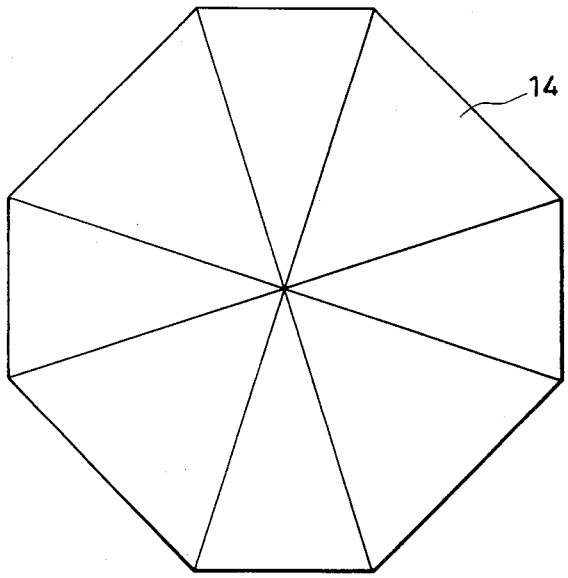

FIGS. 3(*a*) through 3(*c*) illustrate, by way of example, the cross-sectional shapes of columns T useful in the practice of this invention. They include respectively plate-like parts y1,z1, which extend in two directions Y,Z extending at an angle of 135 degree, and plate-like parts y2,z2 extending in directions perpendicular to the directions Y,Z so that panels can be provided respectively in the two directions Y,Z. When it is desirous to provide panels at an angle of 180 degrees as shown by way of example in FIG. 2, it is only necessary to combine an additional column $T_A$ in the opposite direction as indicated by two-dot chain lines in the case of the column depicted in FIG. 3(*a*).

Referring next to FIGS. 4 through 8 which illustrate one specific example of the modular house of this invention, the modular house 10 is composed of unillustrated upright columns, four structural wall panels 11, three opening-defining panels 12 each of which includes a window opening, one opening-defining panel 13 having an entrance/exit opening, and a roof member 14 of an octagonal pyramid shape.

Having now fully described the invention, it will be apparent to one of ordinary skill in the art that many changes and modifications can be made thereto without departing from the spirit or scope of the invention as set forth herein.

I claim:

1. A system of prefabricated components for constructing modular houses of various configurations on an area of land determined by a square of predetermined dimensions, said system comprising:

first panels having a width equal to $\frac{1}{3}$ the length of a side of said square;

second panels having a width equal to the square root of 2 times the width of said first panels; and support columns for both said first and second panels, whereby houses of various configurations can be constructed on said square by positioning said columns at points dividing each side of said square into three equal parts and by attaching selected combinations of said panels to said columns.

2. The system of claim 1, wherein at least one of said first panels is solid and opaque, whereby walls free of openings can be included in the modular houses.

3. The system of claim 1, wherein at least one of said second panels defines an opening, whereby doors and windows can be provided in the modular houses.

4. The system of claim 1, wherein at least some of said support columns include means for supporting adjacent panels at an angle of 135+ with respect to one another, whereby houses having in plan view a non-rectangular polygonal shape can be constructed.

5. The system of claim 1 wherein the columns are two-stories long.

6. The system of claim 1, further comprising means for connecting panels at a right angle with respect to one another, whereby modular houses can be constructed to extend to at least one corner of said square area of land of predetermined dimensions.

7. The system of claim 1 wherein said support columns include first and second parallel sides, a third side perpendicular to said first and second sides for attachment to one of said first and second panels, and a fourth side defining an acute angle with one of said first and second sides and an obtuse angle with the other of said first and second sides, whereby the fourth side of one of said support columns can be placed in abutment with the fourth side of another of said support columns, inverted with respect to said one of said support columns, to permit said first and second panels to be arranged in coplanar relationship.

* * * * *

UNITED STATES PATENT AND TRADEMARK OFFICE

CERTIFICATE OF CORRECTION

PATENT NO. : 4,760,676

DATED : August 2, 1988

INVENTOR(S) : MIEKO GOTO

It is certified that error appears in the above-identified patent and that said Letters Patent is hereby corrected as shown below:

Claim 4, line 3, change "135 +" to --135'--.

Signed and Sealed this

Twenty-ninth Day of November, 1988

*Attest:*

DONALD J. QUIGG

*Attesting Officer*

*Commissioner of Patents and Trademarks*